US005878513A

United States Patent [19]

Annovi et al.

[11] Patent Number: 5,878,513

[45] Date of Patent: Mar. 9, 1999

[54] SPORTS FOOTWEAR STRUCTURE WITH REMOVABLE INNER SHOE

[75] Inventors: Giuseppe Annovi; Mario Callegari, both of Montebelluna, Italy

[73] Assignee: Bauer Italia S.p.A., Montebelluna, Italy

[21] Appl. No.: 926,980

[22] Filed: Sep. 10, 1997

[30] Foreign Application Priority Data

Oct. 29, 1996 [IT] Italy ..... PD96A0263

[51] Int. Cl.[6] ..... A43B 5/04; A43B 7/08

[52] U.S. Cl. ..... 36/115; 36/10; 36/3 A

[58] Field of Search ..... 36/3 A, 115, 10, 36/55, 117.6

[56] References Cited

U.S. PATENT DOCUMENTS 4,513,520 4/1985 Koch .
4,534,122 8/1985 MacPhail .
5,608,976 3/1997 Marega et al. .

FOREIGN PATENT DOCUMENTS 57170 8/1982 European Pat. Off. .
9406317 3/1994 WIPO .

*Primary Examiner*—Ted Kavanaugh
*Attorney, Agent, or Firm*—Sughrue, Mion, Zinn, Macpeak & Seas, PLLC

[57] ABSTRACT

The sports footwear described comprises a first and a second footwear element (4, 5) such as an outer upper portion and an inner shoe, one of the elements having, on the corresponding surface facing the other element, at least one localized projection (22–27) which can be housed substantially with shape coupling in a recess (12–17) localized in a corresponding position in the other element so that the elements are connected to one another by the coupling of each projection in the corresponding recess.

15 Claims, 4 Drawing Sheets

SPORTS FOOTWEAR STRUCTURE WITH REMOVABLE INNER SHOE

BACKGROUND OF THE INVENTION

The subject of the present invention is sports footwear structure, particularly but not exclusively designed for fitting on in-line roller skates, of the type comprising a first footwear element made of relatively rigid or semi-rigid material and constituting the outer upper portion of the footwear, and a second, relatively soft footwear element housed in the first element but structurally independent thereof, the second footwear element having an outer surface, a predominant part of the area of which is placed against a corresponding inner surface of the first element.

In the technical field of skates, both roller skates and ice skates, as in the field of ski boots and snow-board footwear, these elements are typically known by the terms of "shell" (with or without a cuff) for the former element, and "inner shoe" for the latter. These terms are therefore used in the following text with the meanings indicated above, with the remark that the element referred to as the shell may include a cuff portion since, although the cuff is not necessarily constructed as an integral part of the shell, it is normally associated therewith to complete the shell, and the second element may include additional padding elements not necessarily formed integrally therewith.

As is known, whether or not the shell is equipped with a cuff, it is generally moulded in relatively rigid plastics material which can hold the foot and transmit to the sports equipment associated therewith—whether it be a ski or the wheel-carrier of a skate—the movements, impulses and actions which bring about the control thereof. The inner shoe, on the other hand, is normally made of a relatively soft and yielding material and has a padding structure suitable for housing the user's foot with the desired degree of comfort.

So that the valued comfort conferred by the soft inner shoe does not conflict with the requirements for the control of the sports equipment, the coupling between the shell and the inner shoe nevertheless has to ensure that the user's foot is held firmly. At the same time, it is preferable for the inner shoe to be removable from the shell, for example, for periodic cleaning operations.

According to the prior art, the inner shoe is housed in the shell removably and is restrained by the tightening of the fastening means which close the shell onto the user's foot. The gripping thus achieved is certainly effective but can be improved.

SUMMARY OF THE INVENTION

The technical problem upon which the present invention is based is that cf providing sports footwear which is designed structurally and functionally to ensure this improved gripping.

The invention also proposes the provision of footwear of which the parts, or at least some of the parts, can be used for assembling footwear of different sizes. This problem is solved by the invention by means of footwear including the aforementioned features and characterized in that one of the elements has, on the corresponding surface facing the other element, at least one localized projection which can be housed substantially with shape coupling in a recess localized in a corresponding position on the other element, so that the elements are connected to one another by the coupling of each projection in the corresponding recess.

BRIEF DESCRIPTION OF THE DRAWINGS

The characteristics and advantages of the invention will become clearer from the following detailed description of a preferred embodiment thereof, described by way of non-limiting example, with reference to the appended drawings, in which.

DETAILED DESCRIPTION OF THE INVENTION

Figure 2:
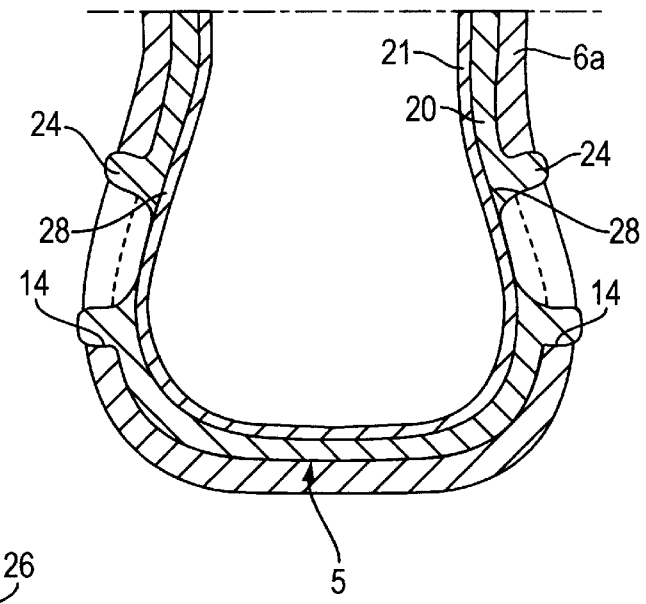
FIG. 2 is a section of a detail of the skate of FIG. 1, taken on the line II—II.
Figure 1:
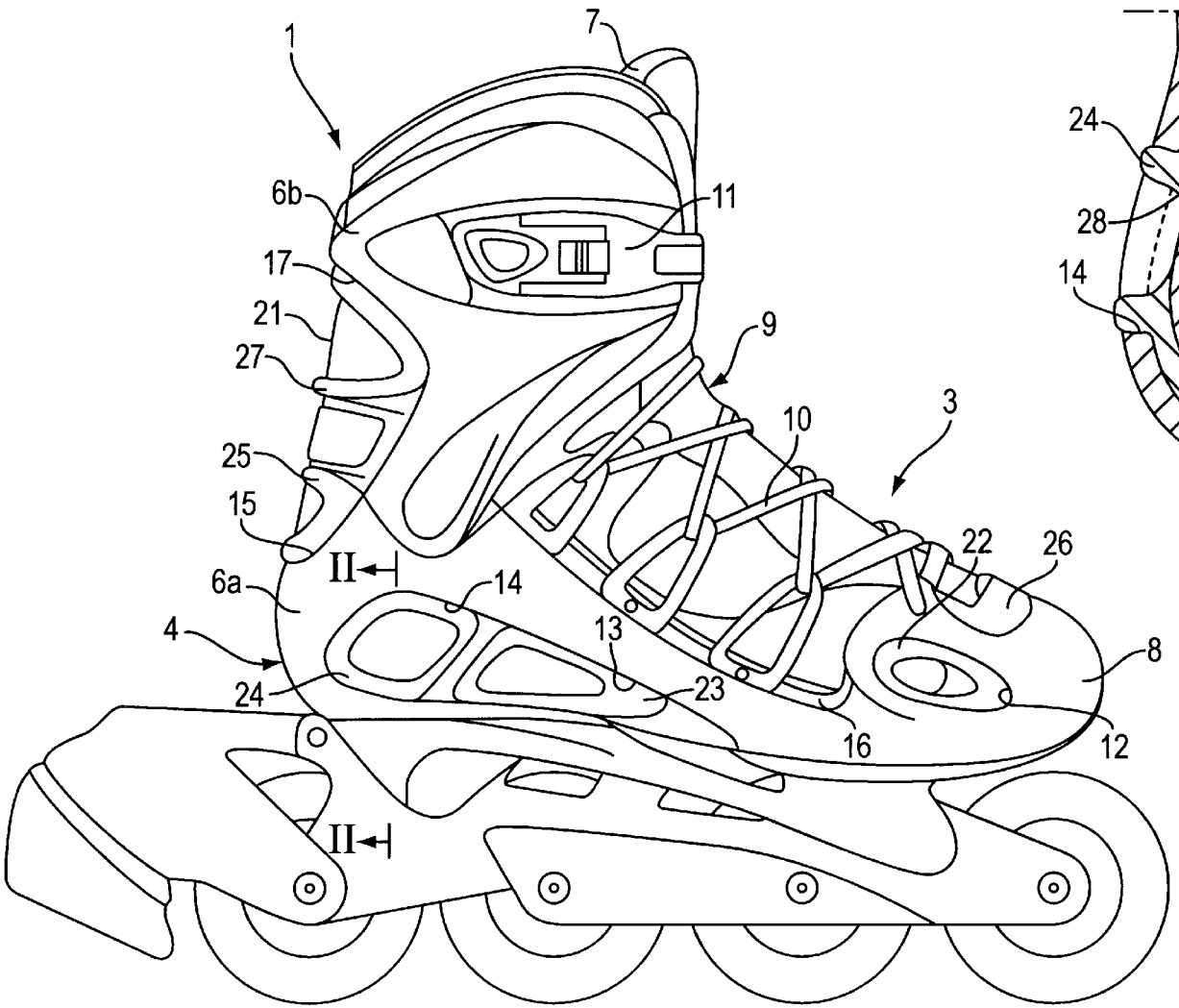
FIG. 1 is a side elevational view of an in-line roller skate formed in accordance with the invention.

In the drawings, an in-line roller skate formed in accordance with the invention is generally indicated 1. It should be understood that, although the invention is described with specific reference to the skate of FIG. 1, for the production of which it is particularly advantageous, it may be used in the production of other sports footwear such as walking boots, ski-boots, snow-board boots, etc.

The skate 1 comprises a carrier 2 and a footwear 3 associated with one another in conventional manner or, in any case, in a manner not concerning the present invention. The footwear 3 in turn comprises an outer upper portion or shell 4 of relatively rigid plastics material and an inner shoe 5 fitted inside it.

The shell 4 comprises a lower portion 6*a* for housing the user's foot and an upper portion or cuff 6*b* to be wrapped around the ankle. These portions are articulated to one another and are open at the front along a line extending from an opening 7 for the fitting-on of the footwear towards the toe 8, extending through the instep region 9 of the foot.

Adjacent the front openings, they bear fastening devices such as a lace fastening 10 (for the first portion) and a lever fastening 11 (for the cuff).

The shell portions 6*a*, 6*b* also have respective localized holes, indicated 12, 13, 14, 15, 16 and 17. These holes preferably extend through the shell but it is intended that they may be in the form of recesses or depressions in the internal surface of the shell or outer upper portion (that is, the surface facing the inner shoe) and not necessarily extending through the outer surface, particularly when there are problems of waterproofness of the footwear. However, it is preferable for the holes 12–17 to be through-holes whenever it is desirable to favour ventilation of the footwear.

It is pointed out that the hole 16 is incorrectly included amongst the holes 2–15 and 17 provided for by the invention since, in most cases, it is in any case also provided in footwear of the prior art; however, some details explained further below justify its partial functional association with the holes 12 to 17 in the other portions of the shell.

The inner shoe 5 in turn comprises a main padding element 20 of expanded, injected resin, formed, for example, by polyurethane or ethylvinyl acetate (EVA) resin, one or more auxiliary padding elements dealt with in detail below, and a fabric lining or covering 21 which covers at least its inner surface which faces the user's foot. It may be formed in a single piece, according to a first aspect of the present invention (FIGS. 5 and 6), or in several pieces, according to a second aspect of the invention, as in the embodiments of FIGS. 3 and 4.

The important aspect, however, which characterizes both of the aforementioned embodiments lies in the fact that, for each of the holes 12 to 17 of the shell or outer upper portion, the inner shoe 5, that is, its main padding element 20, has a corresponding number of localized projections, indicated 22 to 27, which are housed substantially with shape coupling in the corresponding recesses indicated above.

Each projection 22–27 extends like a frame around a window 28 extending through the padding 20 but not through the textile covering 21. These windows 28 permit optimal ventilation of the user's foot inside the inner shoe 5.

The coupling between the projections 22–27 and the corresponding holes 12–17 grips the inner shoe 5 releasably inside the shell 4. All of the holes 12, 13 and 14 of the shell and the corresponding projections 22, 23 and 24 of the inner shoe are located on both sides of the footwear although they are shown only on the outer side. The fact that the holes 13, 14, 15 and 17 of the shell and the corresponding projections 23, 24, 25 and 27 of the inner shoe are preferably concentrated in the rear portion of the footwear achieves improved gripping of the heel region of the inner shoe in the shell, with improved restraint and gripping of the inner shoe and consequently of the user's foot in the footwear. When the footwear is intended for controlling sports equipment such as a ski, a skate, or a snow-board, this improved grip results in better control of the sports equipment fixed to the footwear.

It is pointed out that all of the projections and the respective holes, except for the projection 26 extending inside the hole 16, have closed outlines. Although the projection 26 and the corresponding hole 16 have open outlines, they nevertheless achieve shape coupling which cooperates in the gripping of the inner shoe 5 in the shell 4 and, for this reason, they are functionally associated with the rest of the projections and holes.

It has been noted that, since the inner shoe can be fixed to the shell or outer upper portion of the footwear so as to connect these footwear elements to one another, it is possible to form the inner shoe and even its main padding element 20 in several separate portions, possibly interconnectible by rivets, adhesives or other similar devices, so that these inner-shoe portions can be adapted to footwear of the same or similar type but of different sizes.

Figure 5:
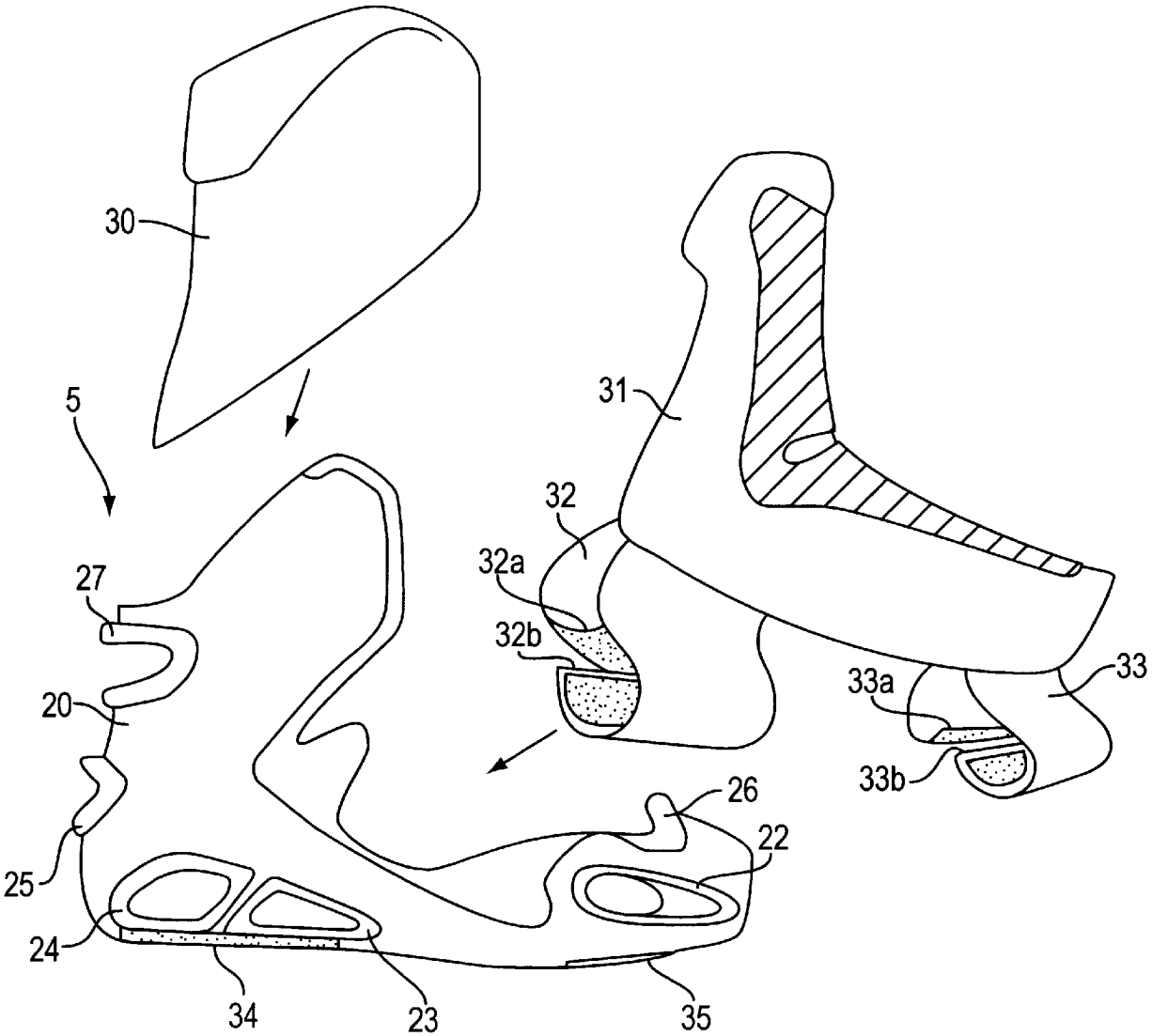
FIG. 5 is an exploded view of an inner shoe for the skate of the preceding drawings.
Figure 6:
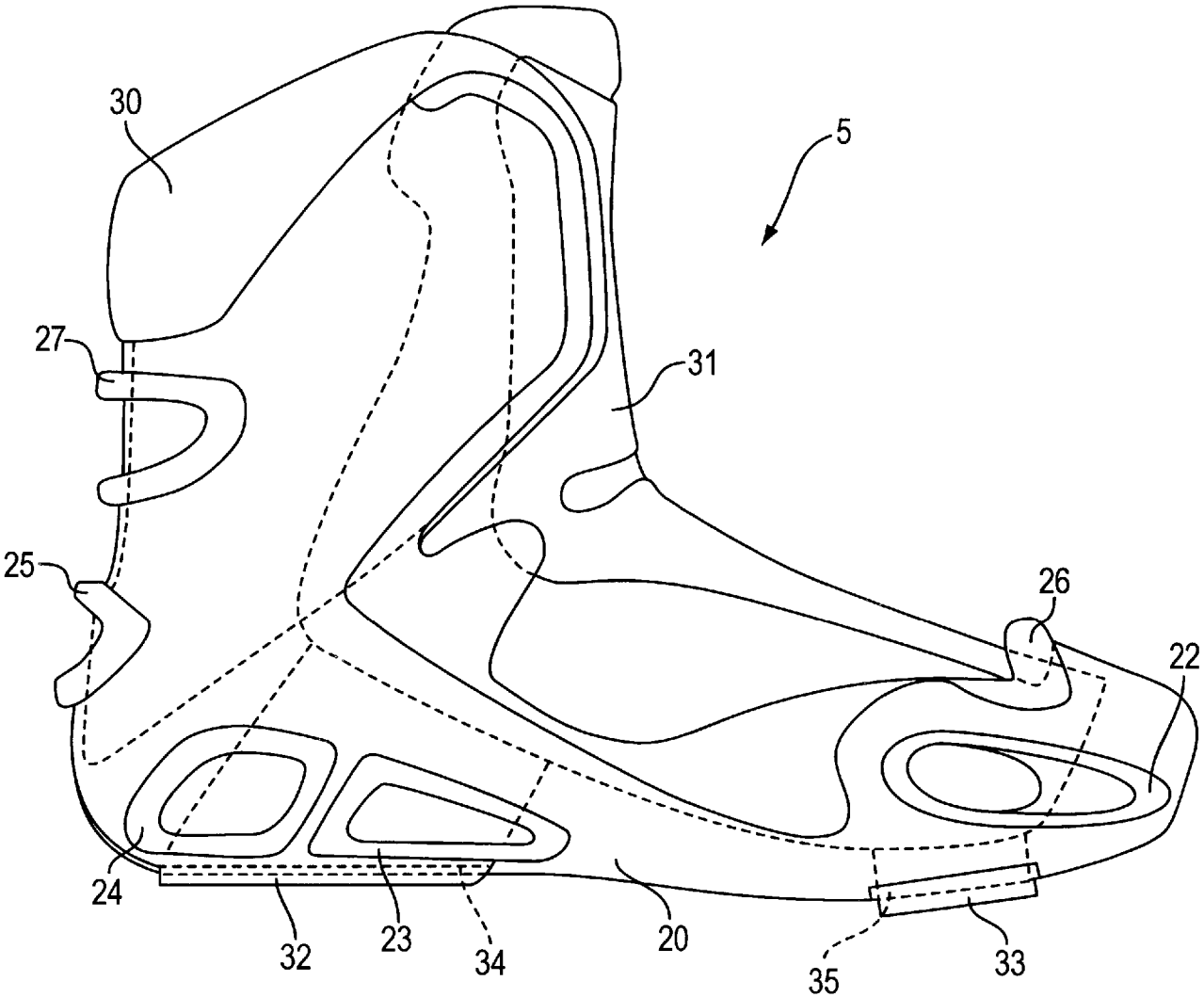
FIG. 6 is a side elevational view of the inner shoe of FIG. 5.

With reference to the embodiment of FIGS. 5 and 6, the inner shoe can be formed with a single main padding element 20 which is associated removably with an additional rear padding element 30 constituting a support for the user's calf and an additional front padding element 31 in the form of a tongue of the footwear 3. The padding element 31 is connected resiliently to the main padding element 20 by means of two resilient bands 32, 33, of which the end portions 32*a*, 32*b* and 33*a*, 33*b* which are intended to overlap in use, have respective pull-fastening means and counter-means of the type known commercially by the registered trade mark VELCRO. The bands 32, 33 are inserted in respective slots 34, 35 in the lower portion of the main padding element 20 on which the sole of the foot bears, passing beneath the inner shoe between the latter and the shell, and being closed onto one another. The tongue 31 is thus not only connected resiliently to the main padding element 20 so as to be movable away from and towards it, but can also be adapted to feet of different sizes, taking advantage of the aforementioned resilience.

Figure 3:
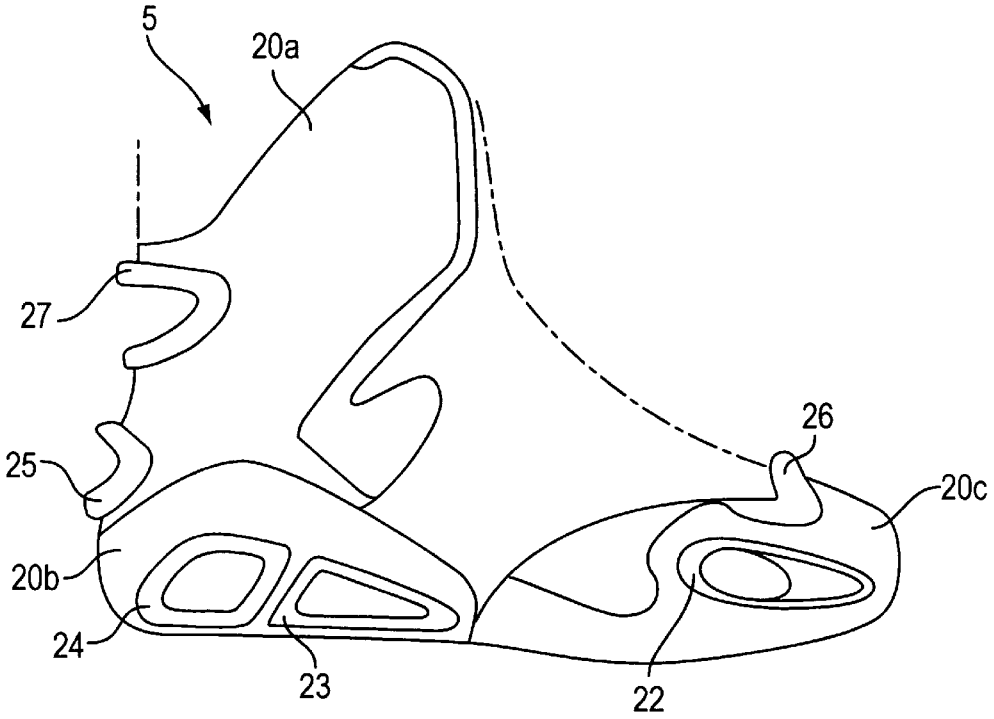
FIGS. 3 and 4 are side elevational views of a detail of the inner shoe of the skate of FIG. 1.
Figure 4:
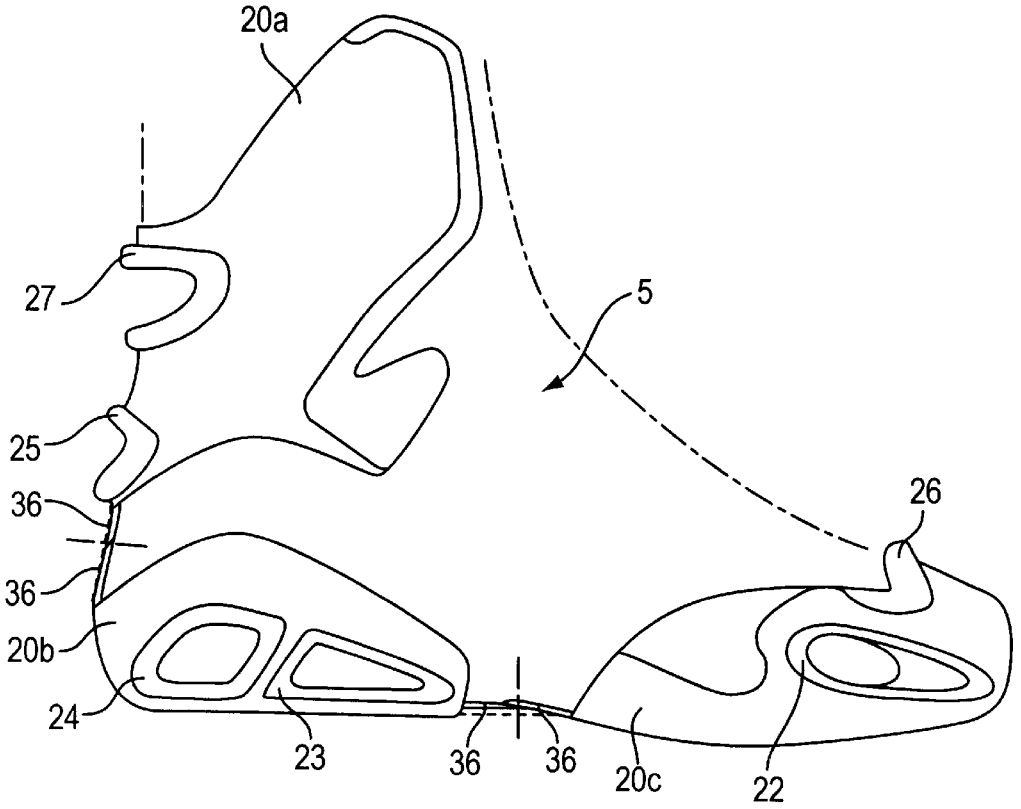

With reference to the embodiment of FIGS. 3 and 4, the main padding element 20 may also be composed of two or more portions—three portions, indicated 20*a*, 20*b* and 20*c*, in the embodiment considered—associated with one another releasably either by means of the coupling with the shell 4 or (and preferably) by means of tabs 36 which project in positions facing the portions 20*a, b, c* and which are connected in pairs by means of gluing, rivetting or other similar connection means, so as to join the aforementioned parts together. The main padding element 20 can thus be adapted to feet of different sizes; clearly, the situation is exaggerated in FIGS. 3 and 4 for greater clarity of representation.

The invention thus achieves the object proposed, offering many advantages both with regard to improved gripping of the inner shoe in the outer upper portion of the footwear and with regard to greater adaptability to feet of different sizes. By virtue of the improved gripping of the inner shoe when it is fitted in the shell, this gripping no longer being entrusted exclusively to the fastening means of the shell, the design of the inner shoe can be modified so as to facilitate its removal, for example, in order to wash the portions thereof which are subject to soiling.

What is claimed is:

1. A sports footwear structure comprising a first footwear element (4) made of relatively rigid or semi-rigid material, constituting an outer, upper portion of the footwear, and a second, relatively soft inner shoe (5) removably inserted in the first element (4) the inner shoe (5) having an outer surface which is placed against a corresponding inner surface of the first element, characterized in that one of the elements (4, 5) has, on the corresponding surface facing the other element, at least one localized projection (22–27) which can be housed substantially with shape coupling in a recess (12–17) localized in a corresponding position on the other element so that the elements (4, 5) are connected to one another by the coupling of each projection (22–27) in corresponding recess (12–17), in which the recesses (12–17) extend through the first footwear element (4).

2. A footwear structure according to claim 1, in which the first footwear element comprises a shell (4) of rigid or semi-rigid plastics material.

3. A footwear structure according to claim 2, in which the first footwear element comprises a cuff (6*b*) articulated to the shell (4).

4. A footwear structure according to claim 1, in which the projections and recesses are located on both sides of the footwear.

5. A footwear structure according to claim 4, in which the projections and recesses are further located in the rear portion of the footwear, in a heel region.

6. A footwear structure according to claim 1, in which the inner shoe (5) is made of expanded plastics material.

7. A footwear structure according to claim 1, in which the projections have at least one window (28) for the ventilation of the inner shoe (5).

8. A footwear structure according to claim 7, in which each projection extends like a frame around at least a portion of the corresponding opening in the inner shoe.

9. A footwear structure according to claim 7, in which the inner shoe is covered at least partially internally by a lining (21), the lining also covering the corresponding windows (28).

10. A footwear structure according to claim 1, in which the second footwear element (5) comprises a main padding element (20) and at least one additional padding element (30) which are structurally independent of one another.

11. A footwear structure according to claim 10 in which the at least one additional padding element comprises a tongue (31) of the second footwear element (5), the tongue (31) being connected resiliently to the main padding element (20).

12. A footwear structure according to claim 11, in which the tongue (31) comprises at least one resilient band (32, 33), the end portions (32*a*, 32*b*, 33*a*, 33*b*) of which are inserted through corresponding slots (34, 35) of the main padding element (20) in order to be closed onto one another.

13. A footwear structure according to claim 10, in which the main padding element (20) can be disassembled into at least three portions (20*a*, 20*b*, 20*c*).

14. A footwear structure according to claim 13, in which each of the portions (20*a*, 20*b*, 20*c*) has at least one of the projections (22–27) and all of the portions are restrained on the other footwear element by the coupling of the respective projections (22–27) in the corresponding recesses (12–17).

15. A footwear structure according to claim 14 in which the portions (20*a,b,c*) of the main padding element (20) are associated with one another releasably.

* * * * *